US005714084A

United States Patent [19]

Fujita et al.

[11] Patent Number: 5,714,084

[45] Date of Patent: Feb. 3, 1998

[54] ELECTRORHEOLOGICAL MAGNETIC FLUID AND PROCESS FOR PRODUCING THE SAME

[75] Inventors: Toyohisa Fujita, Akita; Kenji Yoshino, Aichi, both of Japan

[73] Assignees: Toyohisa Fujita, Aikita; Nittetsu Mining Co., Ltd., Tokyo; Hitachi Powdered Metals Co., Ltd., Chiba, all of Japan

[21] Appl. No.: 579,429

[22] Filed: Dec. 27, 1995

Related U.S. Application Data

[62] Division of Ser. No. 341,938, Nov. 16, 1994, Pat. No. 5,507,967.

[30] Foreign Application Priority Data

Feb. 14, 1994 [JP] Japan ..... 6-37554

[51] Int. Cl.[6] ..... C10M 171/00; C10M 169/04; H01F 1/44

[52] U.S. Cl. ..... 252/73; 252/62.52; 252/62.54; 252/77; 252/78.1; 252/572

[58] Field of Search ..... 252/73, 77, 78.1, 252/572, 62.52, 62.54

[56] References Cited

U.S. PATENT DOCUMENTS

| | | | |
|---|---|---|---|
| 4,356,098 | 10/1982 | Chagnon | 252/62.51 |
| 4,619,861 | 10/1986 | Nakayama et al. | 428/220 |
| 5,075,021 | 12/1991 | Carlson et al. | 252/73 |
| 5,135,672 | 8/1992 | Yabe et al. | 252/62.52 |
| 5,240,626 | 8/1993 | Thakur et al. | 252/62.54 |
| 5,271,858 | 12/1993 | Clough et al. | 252/74 |
| 5,505,880 | 4/1996 | Kormann et al. | 252/62.54 |

FOREIGN PATENT DOCUMENTS

| | | |
|---|---|---|
| 0394049 | 10/1990 | European Pat. Off. . |
| 63-97694 | 4/1988 | Japan . |
| 7-62276 | 3/1995 | Japan . |

OTHER PUBLICATIONS

Journal of Magnetism and Magnetic Materials, vol. 122, pp. 29–33 (North–Holland 1993), "Viscosity of electrorheological magneto–dielectric fluid under electric and magnetic fields".

*Primary Examiner*—Christine Skane

*Attorney, Agent, or Firm*—Sughrue, Mion, Zinn, Macpeak & Seas, PLLC

[57] ABSTRACT

An electrorheological magnetic fluid including an electrically insulating liquid and fine particles dispersed therein is described, wherein the fine particles include a fine magnetic particle as a core, wherein the fine magnetic particle has a surface which is covered by an electroconductive substance, and the fine magnetic particle with its surface covered by the electroconductive substance is completely coated with a surfactant. A process for producing the electrorheological magnetic fluid is also described.

11 Claims, 4 Drawing Sheets

ELECTRORHEOLOGICAL MAGNETIC FLUID AND PROCESS FOR PRODUCING THE SAME

This is a divisional of application Ser. No. 08/341,938 filed Nov. 16, 1994 now U.S. Pat. No. 5,507,967.

FIELD OF THE INVENTION

The present invention relates to an electrorheological magnetic fluid suitable for use as a working fluid for, for example, dampers and actuators. The present invention also relates to a process for producing the electrorheological magnetic fluid (magneto electrorheological fluid).

BACKGROUND OF THE INVENTION

When an electric field is externally applied to a dispersion obtained by dispersing dielectric solid particles into an electrically insulating liquid, the viscosity of the dispersion changes according to the degree of the applied voltage. This phenomenon is known as the Winslow effect or an electrorheological effect (hereinafter abbreviated as "ER effect") and is described in T. Fujita et al., *Journal of Magnetism and Magnetic Materials*, vol.122, pp.29–33 (North-Holland 1993). In this ER effect, the viscosity and shear stress of the dispersion as a whole apparently increase because solid particles in the dispersion are internally polarized by the action of the electric field and the polarized solid particles are statically aggregated with each other.

The fluid which produces this ER effect is called an ER fluid. Examples thereof include fluids comprising an electroinsulating liquid (e.g., paraffin oil, ester oil, ether oil, or silicon oil) and having dispersed therein (a) water-containing solid particles comprising water-absorbing or hydrophilic solid particles (e.g., cellulose, silica gel, starch, an ion-exchange resin) containing water or alcohol or (b) water-free solid particles obtained by insulating electroconductive particles (e.g., a metal, a semiconductor, or a ferroelectric substance) or electroconductive polymer particles in which polymer particles are coated with a metal.

Since the ER effect is excellent in response and controllability to applied voltage, use of the ER fluid as a working fluid for various machines and apparatus has been investigated. For example, a damper and an actuator both employing the ER fluid have been proposed.

On the other hand, a solution comprising an insulating liquid and having dispersed therein magnetic particles having a surfactant adsorbed thereon has been known as a magnetic fluid. A known representative magnetic fluid is obtained by adsorbing oleic acid onto magnetite particles and dispersing the resulting particles into kerosene.

This magnetic fluid is characterized in that the magnetic particles in the fluid attract each other by application of an external magnetic field and, as a result, the viscosity of the fluid apparently increases. Accordingly, since the viscosity of a magnetic fluid is controllable with an external magnetic field, use of a magnetic fluid as a working fluid for various machines and apparatus has been investigated in the same manner as the ER fluid described above.

A fluid having the properties of an ER fluid and those of a magnetic fluid, wherein the viscosity thereof is controllable with both an external electric field and an external magnetic field, has been reported (T. Fujita et al., *Journal of Magnetism and Magnetic Materials*, vol.122, pp.29–33 (North-Holland 1993)). Specifically, this reference discloses that a mixed fluid which is a mixture of a dielectric fluid containing barium titanate showing an ER effect with a kerosene-based magnetic fluid responds to both an external electric field and an external magnetic field so that the viscosity thereof can be changed.

As described above, the viscosities of an ER fluid, a magnetic fluid, and a mixture thereof can be easily controlled with an external electric field, an external magnetic field or both. Accordingly, use of these fluids as a working fluid for various machines and apparatus such as dampers and actuators has been investigated.

However, the ER fluid has the following problems. That is, the ER fluid containing water-containing solid particles has a problem that, although such ER fluid produces an ER effect at room temperatures, the ER effect is deteriorated or is hard to reveal at high temperatures because of vaporization of water. On the other hand, with regard to the ER fluid containing water-free solid particles, there is a problem that the great ER effect which is sufficient for practical use has not yet been obtained.

In the same manner, the magnetic fluid also has similar problems that a magnetic fluid having a sufficient magnetic aggregation effect has not yet been obtained.

Further, when the particles having a larger diameter are used, it is undesirable that a phase separation occurs because of the settling of the particles in the electroinsulating liquid and, as a result, the ER or magnetic effect is deteriorated or is hard to reveal.

In order to overcome the above problem, in general, two or more electroinsulating liquids are blended or an additive such as a surfactant, dispersant or antisettling agent is added in order to inhibit settling of the particles by reducing the difference in specific gravity between the particles and the dispersion medium and to control the phase separation by improving the dispersibility.

However, the technique of adjusting the difference in specific gravity between the electroinsulating liquid and the particles not only has a problem of having difficulty in specific gravity regulation, but also has a serious problem that even when an electroinsulating liquid having a large specific gravity can be prepared, this liquid is not applicable to particles having an even larger specific gravity. As a result, combinations of electroinsulating liquids With particles are limited.

The technique of improving the dispersibility of particles by adding an additive such as a surfactant, dispersant, or anti-settling agent is disadvantageous in that although such an additive is effective in improving dispersibility to some degree, the additive should be used in a considerably large amount for sufficiently homogeneously dispersing the particles having a large diameter. In the ER fluid, in particular, the addition of a large amount of such an additive may change the permittivity of the electroinsulating liquid to influence the ER effect. The addition of an additive is also undesirable because the cost increases.

On the other hand, the mixed fluid obtained by mixing an ER fluid with a magnetic fluid has both the above-described problems of the ER fluid and those of the magnetic fluid. In addition, since dielectric particles and magnetic particles coexist in the same insulating liquid, the concentration of the former particles and that of the latter particles in the fluid are low and, hence, the ER effect and the effect of magnetic aggregation in the mixed fluid are weaker than in the ER fluid alone and in the magnetic fluid alone, respectively. Accordingly, when an ER fluid is mixed with a magnetic fluid, there is a case where the viscosity characteristics of the mixed fluids are inferior to the ER fluid alone and to the magnetic fluid alone.

Even if the particle concentration is desired to be increased, the increase of the particle concentration has a limit because the concentration of all particles in a fluid is limited as described above and, hence, an increase in the concentration of either of dielectric particles and magnetic particles only results in a decrease in the concentration of the other particles. Accordingly, the effect in the mixed fluid cannot be heightened remarkably.

As described above, an ER or magnetic fluid having properties sufficient for practical use has not yet been obtained.

SUMMARY OF THE INVENTION

The present invention has been completed in order to solve the problems described above. In other words, an object of the present invention is to provide an electrorheological magnetic fluid in which the viscosity thereof can increase remarkably by the action of an external electric field, an external magnetic field or both, the viscosity can be controllable easily and precisely, the dispersibility of the particles is excellent, and the viscosity characteristics are sufficient for practical use.

Another object of the present invention is to provide a process for producing the electrorheological magnetic fluid.

The present inventors have made intensive studies in order to solve the problems described above. As a result, it has been found that an electrorheological magnetic fluid having the properties of an ER fluid with the properties of a magnetic fluid and has excellent dispersibility can be obtained by depositing or coating an electroconductive substance on the surfaces of magnetic fine particles and coating the whole surfaces of the resulting particles with a surfactant. The present invention has been completed based on this discovery.

Accordingly, these and other objects of the present invention have been accomplished with an electrorheological magnetic fluid comprising an electroinsulating liquid and fine particles dispersed therein, wherein the fine particles comprise a fine magnetic particle as a core, wherein the fine magnetic particle has a surface which is covered by an electroconductive substance, and wherein the fine magnetic particle with its surface covered by the electroconductive substance is completely coated with a surfactant.

Further, these and other objects of the present invention have been accomplished with a process for producing an electrorheological magnetic fluid, which comprises the steps of adding an aqueous metal salt solution and a reducing agent to a solution containing fine magnetic particles dispersed therein; covering the surface of the fine magnetic particles with metal of the aqueous metal salt solution by electroless plating to form metal-coated particles; adding a surfactant and an alkali thereto to coat the whole surface of the metal-coated particles with a film of the surfactant and thereby form surfactant-coated particles; and dispersing the surfactant-coated particles into an electrically insulating liquid.

Moreover, these and other objects of the present invention have been accomplished with a process for producing an electrorheological magnetic fluid, which comprises the steps of adding an electroconductive monomer to a solution containing fine magnetic particles dispersed therein; electrolytically polymerizing the monomer to cover the surface of the fine magnetic particles with an electroconductive polymer and thereby form polymer-coated particles; adding a surfactant and an alkali thereto to coat the whole surface of the polymer-coated particles with a film of the surfactant and thereby form surfactant-coated particles; and dispersing the surfactant-coated particles into an electrically insulating liquid.

DETAILED DESCRIPTION OF THE INVENTION

Figure 1:
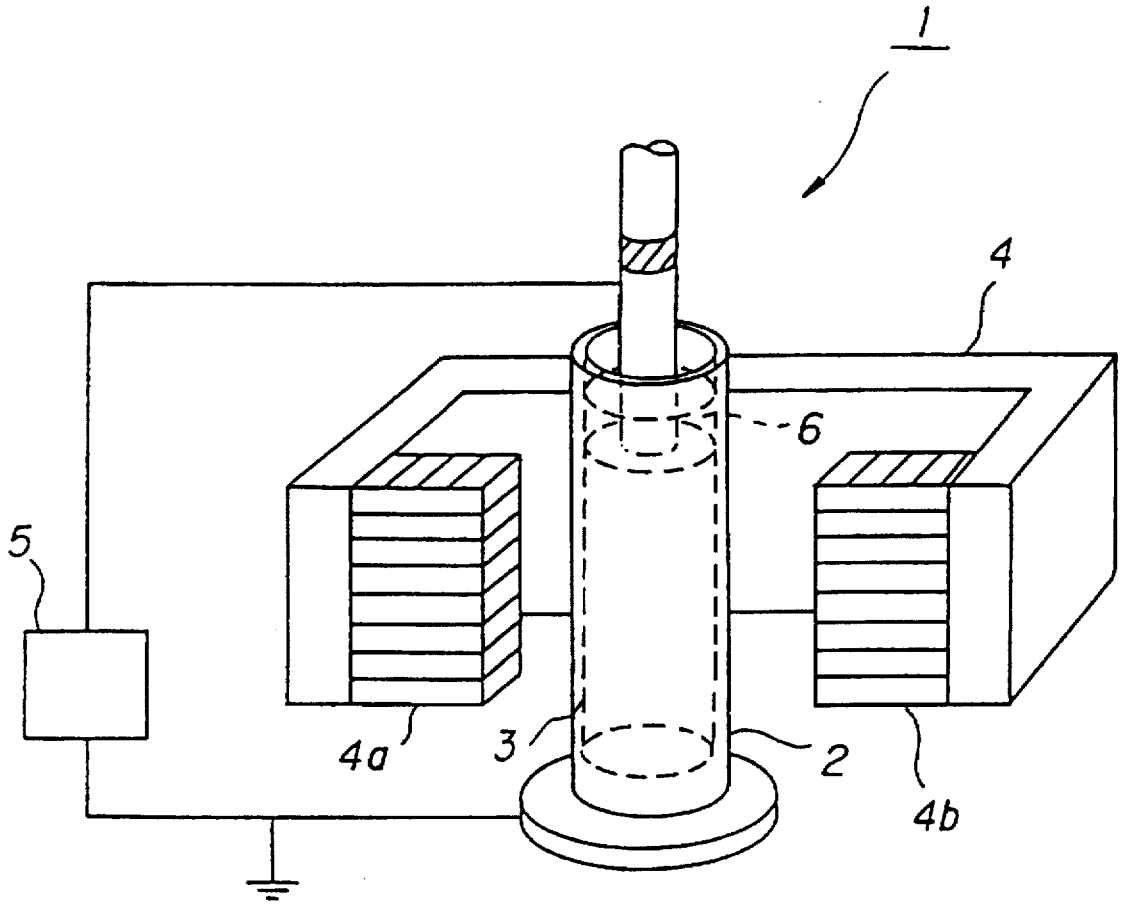
FIG. 1 is a diagrammatic slant view illustrating the viscometer used in the example described below.

In the present invention, the fine magnetic particle has a surface which is covered by an electroconductive substance. In other words, the electroconductive substance is deposited on the surface of the fine magnetic particle, or a film of the electroconductive substance is formed on the surface of the fine magnetic particle.

Examples of the fine magnetic particles for use in the present invention include ferromagnetic oxides and ferromagnetic metals having a particle diameter of from 5 nm to 300 nm, preferably from 5 nm to 10 nm. Specific examples thereof include fine ferrite particles such as magnetite, fine iron particles, fine cobalt particles, and fine particles of alloys of these metals.

These magnetic particles can be produced by a known method such as coprecipitation, reduction of metal ions, or CVD. In particular, in the case of producing fine ferrite particles, ultrafine particles having a uniform particle diameter of from several nanometers to tens of nanometers can be prepared by the coprecipitation method.

Preferred examples of the metal formed on the surfaces of the fine magnetic particles include noble metals (e.g., gold, platinum, or silver) and corrosion-resistant metals (e.g., palladium, rhodium, or iridium). These metals are deposited or coated by electroless plating on the surfaces of the fine magnetic particles. For this electroless plating, the metal is incorporated in the form of a metal salt into the system along with a reducing agent. Examples of the metal salt include halides such as chlorides, cyanides, sulfites, sulfates, nitrates, and hydrates of these compounds.

This electroless plating is a treatment for imparting an ER effect to the fine magnetic particles. The concentration of the aqueous metal salt solution for use in the electroless plating is preferably from 0.1 to 30% by weight in water and the ratio by weight of the amount of the metal salt to that of the fine magnetic particles is preferably from 1:100 to 200:1.

If the amount of the metal salt is more than the above upper limit, the metal-coated particles may be settled after the metal is covered, and if it is less than the above lower limit, the metal-coated particles cannot be electrically operated.

Further, if the concentration of the aqueous metal salt solution is less than 0.1% by weight in water, gold-coated particles having a ratio by weight of the metal salt to that of the fine magnetic particles of 1:100, for example, cannot be obtained.

The metal-coated surface of the fine magnetic particles is preferably from 1 to 100% of the whole surface thereof.

The average thickness of the coated metal is preferably from 0.1 nm to 10 nm.

Preferred examples of the reducing agent include sodium citrate, tartaric acid, glycerol, aldehydes, glucose, hypophosphorous acid salt, and boron hydride compounds.

The electroless plating is accomplished by dispersing the fine magnetic particles into distilled water, adding a predetermined amount of an aqueous solution of the above-described metal salt thereto, and dropwise adding an aqueous solution of the above-described reducing agent to the mixture while continuously stirring the mixture with heating preferably at from 60° to 95° C. for one minute to 5 hours. If the temperature is lower than room temperature, the reaction does not proceed sufficiently, and the metal thus deposited may have insufficient adhesion strength. For example, if gold is reduced and deposited, 1 to 5 hours are required for terminating the reaction thereof completely, and, if a compound having a high reaction rate is used in silver plating, there is a case where it takes about one minutes to terminate the reaction.

The concentration of the reducing agent in the aqueous solution of the metal salt is preferably from 0.1 to 30% by weight. For example, the reducing agent of 0.1% by weight is sufficient for depositing silver of 1% by weight of the amount of magnetic particles by using a tartaric acid and a sodium borate, and if a silver layer is coated by using an aqueous solution of glucose and ethanol, the reducing agent of 30% by weight is required.

When the fine magnetic particles are produced by a coprecipitation method, an electrolyte such as a chloride or sulfate is adherent to the surfaces of the particles obtained. It is therefore desirable to clean the surfaces of the fine magnetic particles by diionized water or distilled water to remove the electrolyte by decantation or a separator such as a centrifuge prior to the electroless plating. By maintaining the pH of the system at from 9 to 11 by adding sodium hydroxide, potassium hydroxide or an alkali solution such as aqueous ammonia during reaction, metal deposition on the surface of the fine magnetic particle can be attained regardless of the presence or absence of an electrolyte.

In place of the metal described above, an electroconductive polymer can be used in the surface treatment for imparting an ER effect to the fine magnetic particles. That is, the fine magnetic particles may have a surface which is covered by an electroconductive polymer. In this case, the forming of a film of the electroconductive polymer on the surface of the fine magnetic particles is attained not by electroless plating but by the electrolytic polymerization method in which a voltage is applied to an electrolytic solution containing the fine magnetic particles and an electroconductive monomer. As a result, a film of the electroconductive polymer is formed on the surface of the fine magnetic particles, and the film has a thickness in proportion to the quantity of the electricity applied. Examples of the electroconductive polymer include polyacetylene polymers (e.g., polyacetylene), polyphenylene polymers (e.g., polyparaphenylene, polyphenylenevinylene), heterocyclic polymers (e.g., polypyrrole, polythiophene), ionic polymers (e.g., aniline, aminopyrene), polyacene polymers (e.g., polyacene), other polymers (e.g., polyoxyalkylene, polyacrylonitrile, polyoxydiazole, polyphthalocyaine (tetrazine)). Among these, polythiophene is more preferred. This electrolytic polymerization gives fine magnetic particles in which the surface thereof has been coated with the polythiophene film.

The electroconductive polymer-coated surface of the fine magnetic particles is preferably from 30 to 100% of the whole surface thereof.

The average thickness of the coated electroconductive polymer is preferably from 0.1 nm to 100 nm.

The solution containing the thus-obtained fine magnetic particles having a surface which is covered by a metal or an electroconductive polymer (hereinafter abbreviated as "electroconductive substance coated magnetic particles") is allowed to stand in order to separate it into a well dispersed liquid phase and a coagulated solid phase, and only the solution containing well dispersed ultrafine particles suspended in the liquid phase is collected. For the collection of the well dispersed ultrafine particles alone, a centrifuge may be used. These ultrafine particles have an average particle diameter of about 10 nm and, when the ultrafine particles are covered with a surfactant and the electrorheological magnetic fluid containing them described below is formed, these ultrafine particles do not settle in the fluid. Thus, the ultrafine particles have excellent dispersibility.

The ultrafine particles alone are dispersed into distilled water. A surfactant and an alkali are added thereto, and the resulting mixture is heated. As a result, the electroconductive substance coated magnetic particles in which the surface thereof is coated with a film of the surfactant are obtained.

The weight amount of the coated surfactant is preferably from 30 to 50% by weight of the amount of the electroconductive substance-coated magnetic particles.

Examples of the surfactant include sodium oleate, alkylammoniumacetates, alkyl sulfosuccinate salts, n-acylamino acid salts, n-alkyltrimethylenediamine derivatives, and alkali salts of acetic acid. Of these, sodium oleate is preferred.

Examples of the alkali include sodium hydroxide, potassium hydroxide, and aqueous ammonia. Of these, sodium hydroxide is preferred.

The pH of the reaction mixture is adjusted to about 10 by adding the alkali, and the resulting mixture is heated to about 90° C. for 0.3 to 5 hours. If the heating time is less than 0.3 hour, the reaction of coating the surface is insufficient, and if it is more than 5 hours, there is a case where the magnetic particles grow. As a result, a thin surfactant film having a thickness of from 1 nm to 2 nm is formed on the whole surface of each electroconductive substance coated magnetic particle. This thin surfactant film, which is a thin hydrophobic film, serves to improve dispersibility in an electroinsulating liquid, which will be described later, and to electrically insulate the metal or electroconductive polymer on the magnetic particle surface to thereby prevent the occurrence of dielectric destruction under the influence of an external electric field.

Subsequently, the resulting reaction mixture is cooled and then filtered to collect the solid ingredient, which is sufficiently dried to remove the water adherent to the particle surfaces and then dispersed into an electroinsulating liquid. Thus, an electrorheological magnetic fluid according to the present invention is obtained.

Examples of the electroinsulating liquid include kerosene, alkylnaphthalenes, heated silicone oils, paraffin oils, ester oils, ether oils, and silicone oils. Of these, alkylnaphthalenes are preferred because of their low volatility.

The particle concentration in the electrorheological magnetic fluid is from 2 to 60% by weight, preferably from 5 to 55% by weight, and more preferably from 10 to 50% by weight, and this range of the particle concentration is almost the same as those in ordinary ER or magnetic fluids. If the particle concentration therein is less than 2% by weight, response to an external electric or magnetic field is unsatisfactory so that an effect sufficient for practical use cannot be obtained. On the other hand, if the particle concentration therein is more than 60% by weight, the fluid has an extremely high viscosity, and it not only may suffer particle aggregation upon application of an electromagnetic field but also is likely to cause insulating destruction under the influence of an external electric field. In either case, it is not preferable because the intensities of the external electric and magnetic fields to be applied must be increased.

By further conducting a heat treatment after the dispersion, the thermal stability of the electrorheological magnetic fluid can be increased.

In the electrorheological magnetic fluid thus obtained, the magnetic particles serving as cores respond to an external magnetic field, or the metal or electroconductive polymer formed on the magnetic particle surfaces responds to an external electric field. As a result, the particles form clusters oriented in the direction of the lines of magnetic force or in the direction of the lines of electric force.

Accordingly, by applying a magnetic field and an electric field in such a manner that the lines of magnetic force are oriented in the same direction as the lines of electric force, an ER effect and a magnetic aggregation effect are produced to synergistically enhance the aggregation for cluster formation. As a result, the electrorheological magnetic fluid is capable of showing a higher shear stress than an ER fluid alone or a magnetic fluid alone. Moreover, since the electrorheological magnetic fluid responds to both a magnetic field and an electric field, the degree of freedom concerning viscosity regulation increases, and the viscosity of the electrorheological magnetic fluid can be more strictly controlled than that of an ER fluid alone or a magnetic fluid alone.

Further, since each particle responds to both a magnetic field and an electric field, the problem concerning the concentrations of magnetic particles and dielectric particles, as in the conventional mixed fluid comprising a mixture of an ER fluid with a magnetic fluid, is eliminated.

In addition, since the particles dispersed in the electrorheological magnetic fluid are ultrafine particles which have an average particle diameter as small as about 10 nm and a surfactant film covering the surface thereof, the ultrafine particles not only have greatly improved dispersibility to produce an excellent ER effect and an excellent magnetic aggregation effect, but they also have excellent aging stability. The electrorheological magnetic fluid is also superior in cost, because good dispersibility is obtained without adding an additive such as a dispersant or anti-settling agent to the insulating liquid, unlike conventional fluids.

The electrorheological magnetic fluid of the present invention will be explained in greater detail by reference to the following Example, but it should be understood that the present invention is not to be deemed to be limited thereto. Unless otherwise indicated, all parts, percents, ratios and the like are by weight.

EXAMPLE 1

Twenty grams of magnetite having an average particle diameter of 10 nm prepared by a coprecipitation method was dispersed into 800 ml of distilled water to obtain Solution A. One gram of chloroauric acid tetrahydrate was dissolved in 100 ml of distilled water to obtain Solution B. Further, 1 g of sodium citrate was dissolved in 100 ml of distilled water to obtain Solution C.

After Solution A was heated to 90° C., Solution B was added thereto. This mixture was stirred for 10 minutes and then cooled to 20° C. to obtain Solution D. Solution C was subsequently added dropwise over a period of 5 minutes to Solution D with stirring. Thereafter, the resulting mixture was stirred for 10 minutes to conduct electroless plating. Thus, Solution E was obtained which contained fine magnetite particles having gold deposited on the surface thereof.

Solution E was allowed to stand, and only the resulting liquid phase was collected. To this liquid phase was added 10 g of sodium oleate, followed by sodium hydroxide to adjust the pH to 10. This mixture was heated to 90° C. with stirring and maintained for 30 minutes. After cooling, the resulting Solution E was filtered with a filter paper, and the solid ingredient was dried at 60° C. for 48 hours, giving 25 g of particles. These particles were gold-deposited fine magnetite particles having a surface coated with sodium oleate.

The above-obtained particles in an amount of 25 g were dispersed into 50 ml of kerosene, and this dispersion was heated for 2 hours. Thus, 55 ml of an electrorheological magnetic fluid was obtained.

Properties of the electrorheological magnetic fluid thus obtained were examined. Particle density in the fluid can be increased by evaporating the solvent. As one example, the fluid was found to have a density of 907 kg/m$^3$ (13 wt % of particle concentration), a saturation magnetization of 0.012 T, and a volume resistivity of 5 MΩm. The specific inductive capacity of the fluid was about 2 at frequencies of 10 kHz and higher. At frequencies up to 10 kHz, the specific inductive capacity and the dielectric dissipation factor both decreased with increasing frequency.

The electrorheological magnetic fluid was further examined for viscosity characteristics using the apparatus shown in FIG. 1.

FIG. 1 shows a viscometer 1 which comprises two coaxial cylinders, i.e., an outer cylinder 2 and an inner cylinder 3, and a magnet 4 having magnetic poles 4*a* and 4*b* facing each other with the coaxial cylinders therebetween. The outer cylinder 2 and the inner cylinder 3 are connected to each other through a high-voltage AC power supply 5 so that an electric field is generated evenly from the inner cylinder 3 to the outer cylinder 2.

The electrorheological magnetic fluid 6 was packed into the space between the outer cylinder 2 and the inner cylinder 3 of the viscometer 1. While an electric field or a magnetic field was continuously applied, the outer cylinder 2 was rotated to determine the relationship between shear stress and shear rate.

Figure 2:
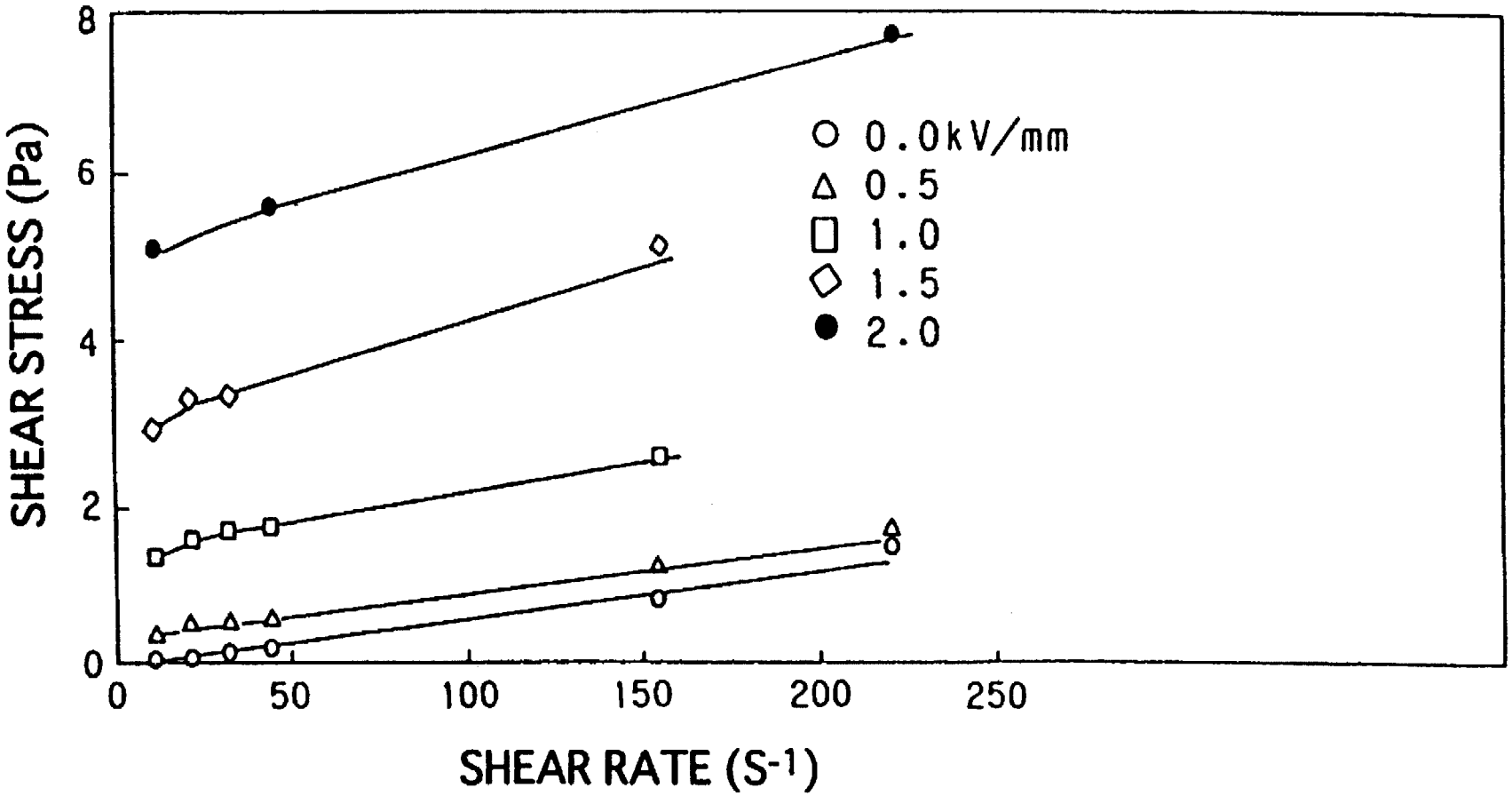
FIG. 2 is a graph showing the relationship between shear stress and shear rate in an electrorheological magnetic fluid according to the present invention under the influence of an electric field alone.

FIG. 2 is a graph showing the relationship between shear stress and shear rate in the electrorheological magnetic fluid to which no magnetic field was applied and only electric fields having various intensities were applied. For the application of electric fields, the high-voltage AC power supply 5 was operated at a frequency of 50 Hz.

As shown in FIG. 2, in the absence of an electric field (and magnetic field), the shear rate was proportional to the shear stress (symbol ○ in FIG. 2), that is, the electrorheological magnetic fluid of the present invention showed the viscosity behavior of a Newtonian fluid. However, upon application of an electric field, the shear stress increased almost in proportion to the second power of the intensity of the electric field in a low-shear-rate region and, thereafter, it increased in proportion to the shear rate. That is, the electrorheological magnetic fluid under the influence of an electric field showed the viscosity behavior of a Bingham fluid. Further, the shear stress increased with increasing intensity of electric field; for example, the shear stress under the influence of an electric field of 2 kV/mm (symbol ● in FIG. 2) was at least ten times as large as that with no electric field when the shear rate was about 50 $s^{-1}$ or less, and the former was at least five times as large as the latter when the shear rate was about 200 $s^{-1}$.

Thus, the electrorheological magnetic fluid of the present invention produces an ER effect by the action of an electric field.

A similar measurement was made under the influence of a magnetic field having a constant strength (i.e., 185 kA/m as measured on the surface of the outer cylinder and 110 kA/m as measured at the center of the inner cylinder). The results of the measurement are shown in FIG. 3.

Figure 3:
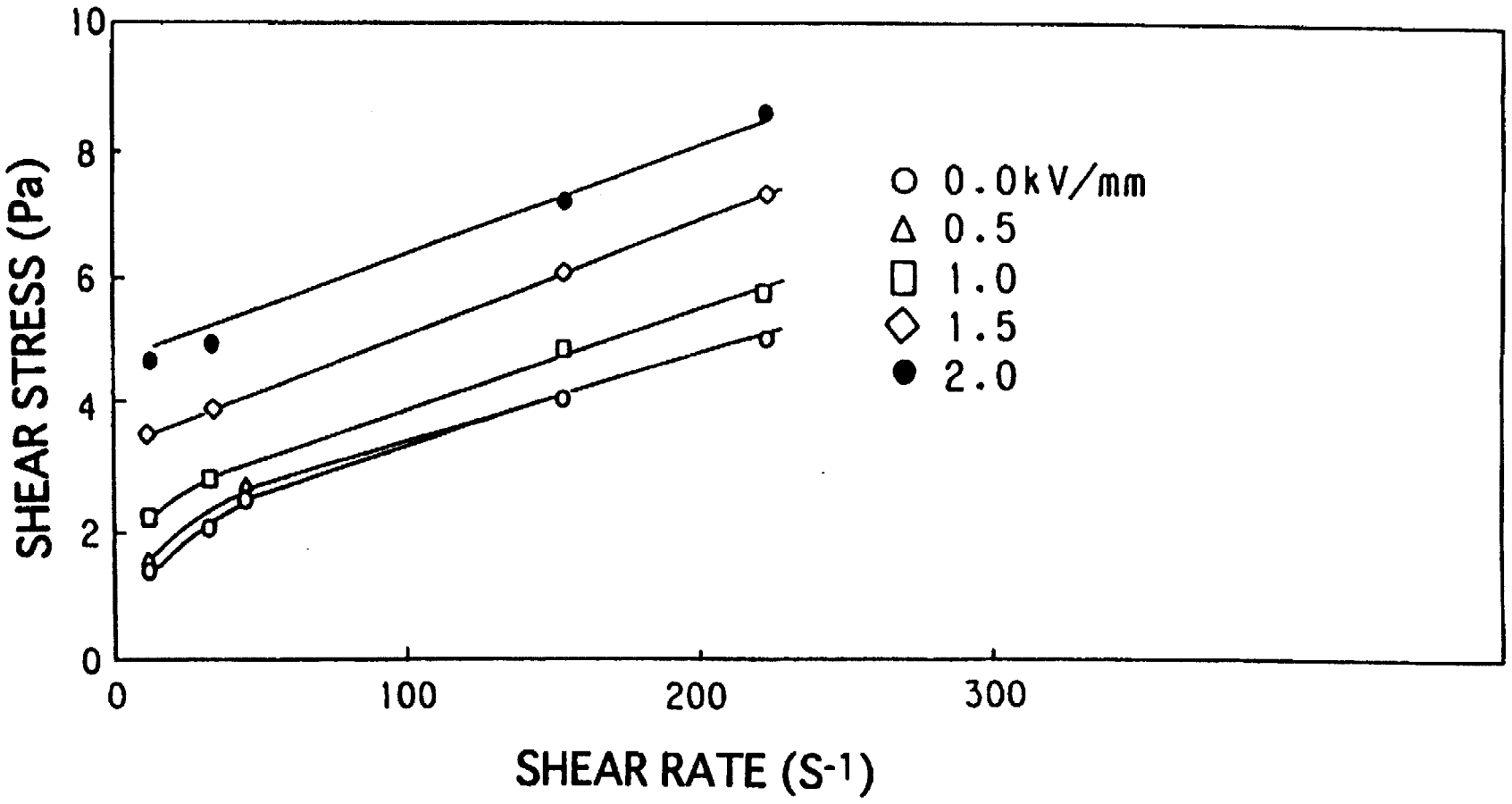
FIG. 3 is a graph showing the relationship between shear stress and shear rate in an electrorheological magnetic fluid according to the present invention under the influence of both a magnetic field and an electric field.

As shown in FIG. 3, the shear stress increased by the action of the magnetic field. For example, the shear stress in the absence of an electric field (symbol ○ in FIG. 3) was higher than the shear stress under the influence of an electric field of 1 kV/mm (symbol □ in FIG. 2). These results show that the application of a magnetic field was effective in enhancing aggregation.

However, at electric-field intensities of 1.5 kV/mm and more (symbols ◇ and ● in FIG. 3), the curves in FIG. 3 were almost the same as those in FIG. 2, with no considerable increase in shear stress. This indicates that at electric-field strengths more than a certain value, the magnetic field becomes less effective in enhancing aggregation, and the electric field becomes predominant.

A shear stress measurement was further made at a constant shear rate of 40 $s^{-1}$ under the influence of 1 kV/mm electric fields having different frequencies, in the presence of a magnetic field and in the absence thereof. The results of the measurement are shown in FIG. 4.

Figure 4:
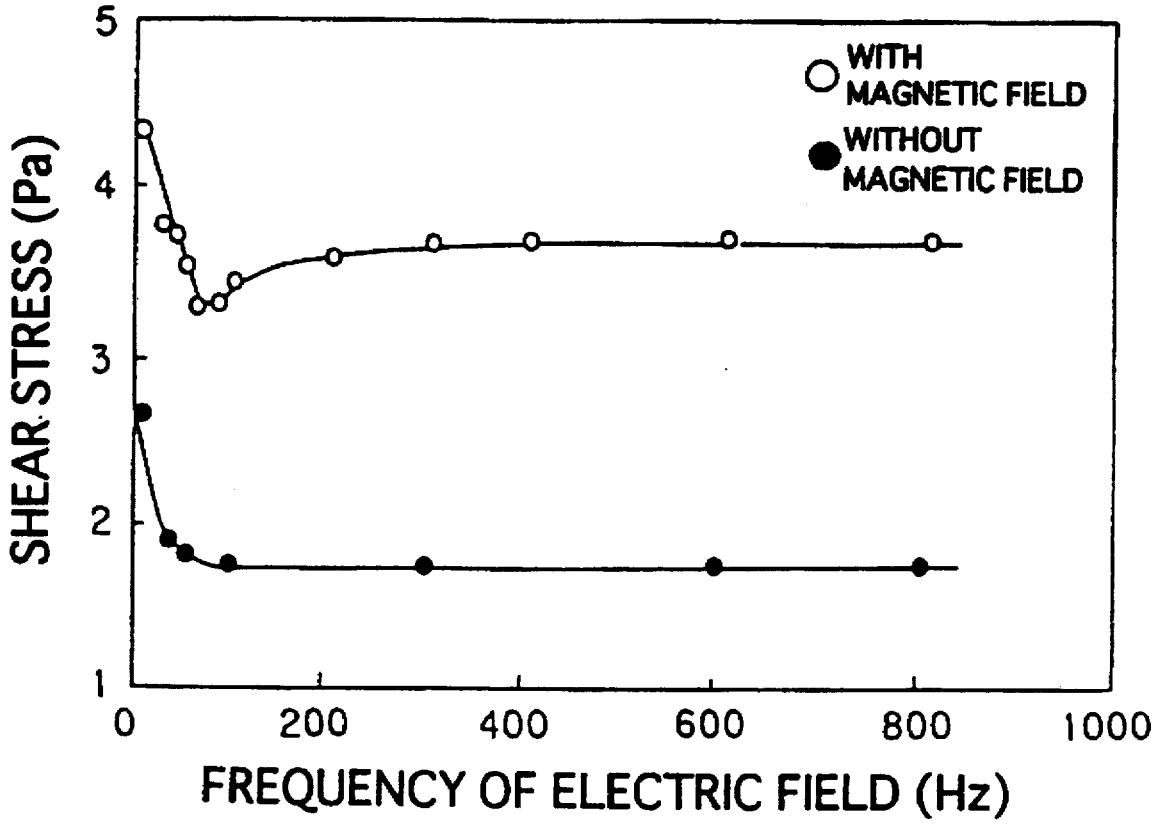
FIG. 4 is a graph showing the results of a shear stress measurement in which electric fields having different frequencies have been applied to an electrorheological magnetic fluid according to the present invention at a constant shear rate.

As shown in FIG. 4, the shear stress under the influence of a magnetic field (symbol ○ in FIG. 4) was higher than the shear stress in the absence of a magnetic field (symbol ● in FIG. 4) over the whole frequency region measured (0 to 800 Hz), indicating that the application of the magnetic field was effective in enhancing aggregation.

With respect to the minimum value of shear stress, the minimum value in the presence of the magnetic field appeared at a lower frequency (around 60 to 70 Hz) than that in the absence of the magnetic field. This shows that the application of the magnetic field reduced the time from cluster formation to cluster destruction, i.e., improved the responsiveness of the fluid.

As described above, in the electrorheological magnetic fluid of the present invention, the magnetic particles serving as cores respond to an external magnetic field, while the metal or electroconductive polymer formed on the surface of the magnetic particles responds to an external electric field. As a result, the particles form clusters oriented in the direction of the lines of magnetic force or in the direction of the lines of electric force. Also shear stress can be increased by increasing the particle density under both electric and magnetic fields.

Accordingly, by applying a magnetic field and an electric field in such a manner that the lines of magnetic force are oriented in the same direction as the lines of electric force, an ER effect and a magnetic aggregation effect are produced to synergistically enhance the aggregation for cluster formation. As a result, the electrorheological magnetic fluid is capable of showing a higher shear stress than an ER fluid alone or a magnetic fluid alone. Moreover, since the electrorheological magnetic fluid responds to both a magnetic field and an electric field, the degree of freedom concerning viscosity regulation increases, and the viscosity of the electrorheological magnetic fluid can be more strictly controlled than that of an ER fluid alone or a magnetic fluid alone. Because of these effects, the electrorheological magnetic fluid of the present invention is advantageously used especially as a working fluid for dampers and actuators.

Further, since each particle responds to both a magnetic field and an electric field, the problem concerning the concentrations of magnetic particles and dielectric particles, as in the conventional mixed fluid comprising a mixture of an ER fluid with a magnetic fluid, is eliminated.

In addition, since the particles dispersed in the electrorheological magnetic fluid are ultrafine particles which have an average particle diameter as small as about 10 nm and which each has a surfactant film covering the surface thereof, the ultrafine particles not only have greatly improved dispersibility to produce an excellent ER effect and an excellent magnetic aggregation effect, but they also have excellent aging stability. The electrorheological magnetic fluid is also superior in cost, because good dispersibility is obtained without adding an additive such as a dispersant or anti-settling agent to the insulating liquid, unlike conventional fluids.

Therefore, the electrorheological magnetic fluid of the present invention is of great industrial usefulness.

While the invention has been described in detail and with reference to specific embodiments thereof, it will be apparent to one skilled in the art that various changes and modifications can be made therein without departing from the spirit and scope thereof.

What is claimed is:

1. An electrorheological magnetic fluid comprising an electrically insulating liquid and fine particles dispersed therein, wherein the fine particles comprise a fine magnetic particle as a core;

wherein the fine magnetic particle has a surface which is covered by an electroconductive substance;

wherein the fine magnetic particle with its surface covered by the electroconductive substance is completely coated with a surfactant;

wherein the electroconductive substance is an electroconductive polymer;

wherein the electroconductive polymer is coated in an average thickness of from 0.1 to 100 nm; and wherein the electroconductive substance is compositionally different than the surfactant.

2. The electrorheological magnetic fluid as claimed in claim 1, wherein the electroconductive polymer is selected from the group consisting of polyacetylene polymers, polyphenylene polymers, heterocyclic polymers, ionic polymers, polyacene polymers, polyoxyalkylene, polyacrylonitrile, polyoxydiazole and polyphthalocyaine (tetrazine).

3. The electrorheological magnetic fluid as claimed in claim 1, wherein the electroconductive polymer is polythiophene.

4. The electrorheological magnetic fluid as claimed in claim 1, wherein the surfactant is selected from the group consisting of sodium oleate, alkylammonium acetates, alkyl sulfosuccinate salts, n-acylamino acid salts, n-alkyltrimethylenediamine compounds, and alkali salts of acetic acid.

5. The electrorheological magnetic fluid as claimed in claim 1, wherein the surfactant is sodium oleate.

6. The electrorheological magnetic fluid as claimed in claim 1, wherein the electroconductive polymer is selected from the group consisting of polyacetylene polymers, polyphenylene polymers, heterocyclic polymers, ionic polymers, polyacene polymers, polyoxyalkylene, polyacrylonitrile, polyoxydiazole and polyphthalocyaine (tetrazine) and the surfactant is selected from the group consisting of sodium oleate, alkylammonium acetates, alkyl sulfosuccinate salts, n-acylamino acid salts, n-alkyltrimethylenediamine compounds, and alkali salts of acetic acid.

7. The electrorheological magnetic fluid as claimed in claim 1, wherein the surfactant is sodium oleate and the electroconductive polymer is selected from the group consisting of polyacetylene polymers, polyphenylene polymers, heterocyclic polymers, ionic polymers, polyacene polymers, polyoxyalkylene, polyacrylonitrile, polyoxydiazole and polyphthalocyaine (tetrazine).

8. The electrorheological magnetic fluid as claimed in claim 1, wherein the electroconductive polymer is polythiophene and the surfactant is selected from the group consisting of sodium oleate, alkylammonium acetates, alkyl sulfosuccinate salts, n-acylamino acid salts, n-alkyltrimethylenediamine compounds, and alkali salts of acetic acid.

9. The electrorheological magnetic fluid as claimed in claim 1, wherein the electroconductive polymer is polythiophene and the surfactant is sodium oleate.

10. The electrorheological magnetic fluid as claimed in claim 1, wherein the fine magnetic particles have an average particle diameter of from 5 nm to 10 nm.

11. The electrorheological magnetic fluid as claimed in claim 1, wherein the electroconductive polymer is formed by electrolytic polymerization.

* * * * *